United States Patent [19]

Roberts

[11] 4,210,492

[45] Jul. 1, 1980

[54] PROCESS FOR THE PYROLYSIS OF COAL IN DILUTE- AND DENSE-PHASE FLUIDIZED BEDS

[75] Inventor: Scott C. Roberts, Houston, Tex.

[73] Assignee: Shell Oil Company, Houston, Tex.

[21] Appl. No.: 777,196

[22] Filed: Mar. 14, 1977

[51] Int. Cl.[2] ..... C10B 23/00; C10B 49/22; C10G 1/02

[52] U.S. Cl. ..... 201/12; 165/104 F; 201/16; 201/31; 201/44; 208/8 R; 422/145; 422/146; 422/206; 422/213

[58] Field of Search ..... 201/3, 4, 8, 12, 16, 201/31, 44; 165/104 F; 23/288 S, 283, 284; 208/8, 11 R; 422/145-147, 206, 213, 215, 223

[56] References Cited

U.S. PATENT DOCUMENTS

| | | | |
|---|---|---|---|
| 1,669,023 | 5/1928 | Aunge | 201/31 |
| 2,560,403 | 7/1951 | Arveson | 48/202 |
| 2,725,348 | 11/1955 | Martin et al. | 23/288 S |
| 2,743,216 | 4/1956 | Jahnig et al. | 201/12 |
| 2,776,935 | 1/1957 | Jahnig et al. | 201/12 |
| 2,955,077 | 10/1960 | Welinsky | 201/31 |
| 3,047,472 | 7/1962 | Gorin et al. | 201/31 |
| 3,076,751 | 2/1963 | Minet | 201/31 |
| 3,574,065 | 4/1971 | Eddinger et al. | 201/12 |
| 3,853,498 | 12/1974 | Bailie | 201/31 |
| 3,855,070 | 12/1974 | Squires | 201/31 |
| 3,921,307 | 11/1975 | Marek et al. | 165/104 F |
| 4,064,018 | 12/1977 | Choi | 201/31 |

FOREIGN PATENT DOCUMENTS

| | | | |
|---|---|---|---|
| 1487133 | 7/1966 | France | 165/104 F |

*Primary Examiner*—Joseph Scovronek
*Assistant Examiner*—Bradley Garris

[57] ABSTRACT

A process for pyrolysis of coal wherein the subdivided coal is preheated, pyrolyzed, and subjected to heat recovery after pyrolysis, heat transfer being effected by contacting the subdivided coal as a dilute-phase fluidized bed in the first stage of dual preheating zones with a first particulate heat carrier, with a second particulate heat carrier in a dense-phase fluidized bed in the second preheating stage, followed by pyrolysis in a dense-phase fluidized bed pyrolysis zone. The separate particulate heat carriers are employed in such manner that one mass of heat carrier is utilized for preheating the subdivided coal in the first stage and heat recovery, and a second mass of heat carrier is utilized for pyrolysis of the coal and the second stage preheating.

4 Claims, 1 Drawing Figure

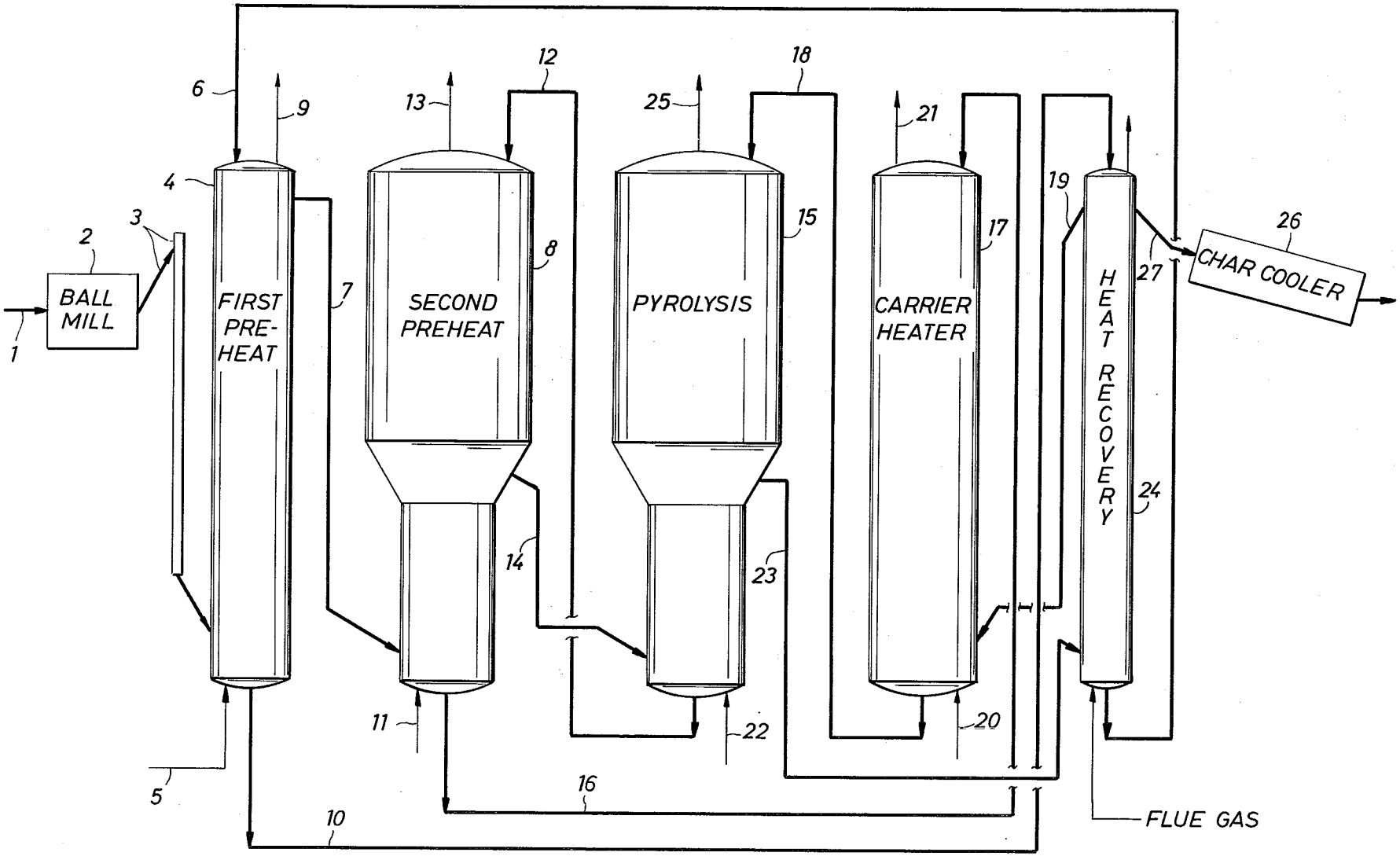
CHAR COOLER
26
27
HEAT RECOVERY
24
FLUE GAS
19
17
CARRIER HEATER
20
21
18
15
PYROLYSIS
23
22
25
16
12
8
SECOND PREHEAT
14
13
11
7
10
9
FIRST PRE-HEAT
6
4
3
5
2
BALL MILL
1

PROCESS FOR THE PYROLYSIS OF COAL IN DILUTE- AND DENSE-PHASE FLUIDIZED BEDS

BACKGROUND OF THE INVENTION

In recent years, an increased and continuing emphasis has been placed on the recovery of hydrocarbonaceous fluids from substantially non-volatile carbonaceous materials such as oil shale, lignite, coal, industrial and municipal solid wastes and the like, as an alternative to conventional production of petroleum from finite and rapidly depleting and underground sedimentary reservoirs. Previous efforts by both governmental agencies and private industry have demonstrated that these alternative or unconventional carbonaceous material-containing resources can be converted with varying degrees of difficulty into volatile hydrocarbonaceous fluids such as combustible gases, motor fuels, heating and fuel oils and various by-products which have value in the chemical and petrochemical industries. In general, the more attractive of the recovery techniques previously proposed invariably involve heat treatment of the substantially non-volatile carbonaceous material in a manner sufficient to distill or otherwise decompose the solid carbonaceous material into the aforementioned volatile products. These techniques, which can be described in most basic terms as retorting or pyrolysis processes, take on a myriad of forms including batch or continuous schemes utilizing fixed or fluidized beds wherein either a portion of the solid carbonaceous material itself is combusted to supply the pyrolysis heat, or the pyrolysis heat is generated externally and supplied to the process via a gaseous (fluidized gas), liquid or solid heat carrier.

Of all the available materials, coal is considered by many to be one of the best candidates for processing in such a retorting or pyrolysis scheme. When coal is pyrolyzed, usuallly at temperatures of about 800° to 1500° C., the solid coal undergoes destructive pyrolysis and is converted to liquid and light gaseous hydrocarbonaceous fluids with a remainder staying as a char having valuable fuel capabilities.

One problem associated with many coals, particularly western coals, is the presence of significant amounts of water in the coal. Such coals, for example, may contain up to 30 or even 40 percent water. This water may be present as a physical mixture or as chemi-absorbed water. Since this large volume of water is not desired in the pyrolysis, steps must be taken to remove the water prior to the heat treatment. The present invention provides an efficient method of water removal, as well as providing for the recovery of a balance of highly valuable products.

SUMMARY OF THE INVENTION

Accordingly, the invention comprises a process for pyrolysis of coal, characterized by efficient water removal and heat transfer, wherein the coal is converted into volatile hydrocarbonaceous fluids and a solid char residue. More particularly, the invention is directed to a pyrolysis process for subdivided coal employing particulate heat carriers in stage-wise heating and in heat recovery from the char residue. According to the invention, particulate heat carrier is passed downwardly at a substantially uniform rate through fluidized beds of the coal under the influence of gravitational force to effect the requisite sensible heat transfer, a primary feature of the invention being the segregation of the heat carrier flows in order to minimized overall thermal stress on the heat carrier.

In summary, the invention comprises a process for pyrolysis of coal wherein the subdivided coal is preheated, pyrolyzed, and subjected to heat recovery after pyrolysis, heat transfer being effected by contacting the subdivided coal as a dilute-phase fluidized bed in the first stage of dual preheating zones with a first particulate heat carrier, with a second particulate heat carrier in a dense fluidized bed in the second preheating stage, followed by pyrolysis in a dense fluidized bed pyrolysis zone. The separate particulate heat carriers are employed in such manner that one mass of heat carrier is utilized for preheating the subdivided coal in the first stage and heat recovery, and a second mass of heat carrier is utilized for pyrolysis of the coal and the second stage preheating.

Moreover, it has been found that water can be removed and hydrocarbonaceous fluids and char residue can be recovered from subdivided coal in a highly effective and energy efficient way if the heat carrier flow is segregated in a specific manner and the sensible heat transfer is carried out in a particular fashion. In this process, which is particularly applicable to coal containing up to about 40 percent water, the subdivided coal is contacted, sequentially, as a fluidized mass in gas in a series of vertically-oriented process zones with particulate solid heat carrier in a manner such that the heat carrier falls or rains through the fluidized mass at a substantially uniform and non-accelerating rate under the influence of gravitational force, falling rate being controlled by heat carrier properties such as specific gravity and particle size and fluidized bed characteristics such as apparent bed density and fluidizing gas velocity. Tracing subdivided solid material flow through the process, the first preheating stage, involving sensible heat transfer from a solid particulate heat carrier, is carried out by fluidizing the subdivided coal in an upward direction with a superficial fluidizing gas velocity at least equal to that known in the art as the "dilute-phase transition velocity", thereby obtaining a dilute-phase, fluidized mass in gas which is contacted countercurrently in the manner described with a particulate heat carrier. In the first preheating process stage, the subdivided coal is heated to an elevated temperature up to the boiling point of water, while in the last or heat recovery stage, heat is recovered from the solid char residue. In the intermediate preheating stage of the process, the preheated subdivided coal in the form of a dense, well-mixed fluidized bed is contacted with particulate heat carrier in the manner described previously to remove water and heat the coal to a point approaching, but below, pyrolysis temperature, the heat carrier having previously been employed for transfer of heat in the pyrolysis zone. In the pyrolysis zone, the coal is heated to a temperature sufficient to pyrolyze the coal, the resultant fluid products being further processed for recovery, and the solid char residue being recovered as well. As noted, the char residue is suitably contacted with the relatively cool first particulate heat carrier for recovery of heat, after which the heat carrier is returned to the first preheat zone or stage. As indicated previously, the flow of particulate heat carrier is segregated in the process scheme such that one mass of heat carrier is utilized in the first preheating and heat recovery stages of the process whereby heat is recovered from the char residue and utilized to preheat incoming coal, while a second mass of heat carrier, heated to a high temperature in a separate carrier heating zone, is utilized for the second preheating zone and the pyrolysis of coal. Preferably, the particle size and specific gravity of the heat carrier is such that it may be pneumatically transported from one process zone to another as necessary in the overall process scheme.

By segregating the particle heat carrier into two distinct masses and circulating each mass through separate and non-intersecting flow circuits in the process scheme, as described above, several distinct advantages are obtained. In the first place, thermal stresses on the total heat carrier charge to the process are reduced, in that only a portion of the total charge is subject to the high temperatures required for heat transfer in the pyrolysis step of the process. A most important advantage is the ability to remove water in the second preheating zone, thus avoiding unduly expensive separation techniques for separating large volumes of water from the coal or fluid products. Further, by segregating the heat carrier flow in the manner described, it is now possible to optimize the heat carrier properties for its particular application in the process by utilizing two different heat carriers, one for the first preheating zone and heat recovery and one for the second preheating zone and pyrolysis. Thus, the particle size of the heat carrier can be larger in the pyrolysis zone—second preheat zone heat carrier flow circuit for easier separation from the char residue but still small enough, if desired, to permit pneumatic transport. This advantage takes on special significance because of the potential economic savings involved in using cheaper, more conventional heat carriers in the first preheating and heat recovery steps. Finally, segregation of the heat carrier flow in the manner described optimizes recovery of thermal energy from the process since the heat content of both the pyrolysis—second preheat zone heat carrier and the heat recovery zone—first preheat zone heat carrier is conserved by return to the pyrolysis carrier heating zone and the first preheating zone, respectively, while at the same time facilitating discharge of char residue at a desirably low temperature as a result of heat exchange in the heat recovery zone with heat carrier cooled to relatively low temperature in the first preheating zone.

Further advantages accrue from the particular fashion in which sensible heat transfer is effected between particulate heat carrier and the subdivided coal in the process sequence of the invention. According to the invention, sensible heat transfer from or to the particulate heat carrier is effected by direct heat carrier contacting of the subdivided coal as a dilute-phase fluidized mass in the first preheating zone, and preferably the heat recovery zone, and as a well-mixed, dense phase fluidized mass in the second preheating and the pyrolysis zones. Thus, by using dilute-phase fluidization in the first preheating and heat recovery zones, the rate and efficiency of heat transfer is maximized since the sensible heat transfer is countercurrent and the degree of subdivided coal backmixing is inherently reduced by dilute-phase operation. Again, dense-phase fluidized beds can be utilized to obtain the longer residence time required for water removal and pyrolysis without causing the second preheat and pyrolysis zones to be prohibitively large. Finally, the properties of the particulate heat carrier in each process flow circuit can be optimized on the basis of heat transfer and reaction rate criteria such that a small particle size, high heat capacity and surface area carrier can be employed to maximize heat transfer in the first preheating and heat recovery stages, whereas a larger particle size carrier can be employed in the second preheat and pyrolysis zones to promote ease of separation from the char residue.

In the preferred form of the invention, the char residue is fluidized in the heat recovery zone in a manner to create a dilute-phase fluidized mass in gas in the heat recovery zone and the first particulate heat carrier is introduced in the upper portion of the heat recovery zone, the first particulate heat carrier having a particle size and density such that it falls through the dilute-phase fluidized mass at a substantially uniform rate and collects in the lower portion of the heat recovery zone along with a minor amount of entrained particulate residue; and the first particulate heat carrier in the lower portion of said heat recovery zone is separated from entrained particulate residue and passed to the first preheating zone where it supplies sensible heat for preheating the subdivided coal.

DETAILED DESCRIPTION OF THE INVENTION

The coal is supplied to the process of the invention in a form fluidizable in gas. The comminution techniques suitably employed in preparing the feedstock are conventional in nature and generally involve grinding or crushing of the solid material to the desired particle size. Generally, it is desirable to reduce the particle size of the largest coal particles to ⅛" or less. This will produce a mass of particulate coal which is readily fluidizable at conventional fluidizing gas velocities. Preferably, the coal is ground to a particle size of 1/16" or less in order to promote separation of the coal particles from particulate heat carrier in the subsequent process stages and to allow the coal to be pneumatically transported to the first preheating stage of the process at minimum carrying gas velocities. Normally the subdivided coal enters the first preheating stage of the process at relatively cool temperatures approximating ambient, i.e., 100° F. or less.

The first preheating stage of the process is carried out in a vertically-oriented process zone wherein the relatively cool subdivided coal in the form of an upwardly moving, dilute-phase fluidized mass in gas is contacted countercurrently with a relatively hot, first particulate heat carrier to effect sensible heat transfer to the coal and heat the coal to an elevated temperature up to the boiling point of water. To effect heat transfer in this first process zone the subdivided coal, typically at a temperature of 100° F. or less, is introduced at a lower portion of the vertically-oriented zone along with a fluidizing carrier gas at a gas velocity sufficient to create an upwardly moving dilute-phase fluidized bed of coal in the process zone. This dilute-phase fluidized bed condition is created when the fluidizing gas velocity exceeds a critical velocity known in the art as the "dilute-phase transition velocity", e.g., see U.S. Pat. No. 3,597,327 and U.S. Pat. No. 3,855,070. At this critical velocity, the fluidized bed density abruptly decreases with a concomitant increase in net upwards velocity of the bulk of the fluidized subdivided solids in the bed. Under these conditions, the fluidized bed thins out in a vertical direction and the path traveled by any given fluidized particle becomes less random and more fixed in the direction of fluidizing gas flow, though a certain amount of refluxing is still encountered due to the formation of stringers of fluidized particles in the bed which quickly diffuse into the upwardly moving fluidizing gas. The net effect of such dilute phase fluidization is to regularize the rate of movement of any given fluidized particle through the fluidization stage, minimize backmixing of fluidized particles and place limits on residence time in the fluidized bed process zone since substantially all of the fluidized particles are thereby conveyed out the upper portion of the vertical process zone of the invention. A dilute-phase fluidized bed condition can be achieved with superficial fluidizing gas velocities of about 8 to 30 ft/sec and solids to fluidizing gas weight ratios of 6–20 to 1, with superficial gas velocities of 10 to 25 ft/sec and coal to gas ratios of 8–20 to 1 being preferred. With these process parameters, the apparent fluidized bed densities suitably range from 1–5 lb/ft$^3$ with densities in the range of 2–4 lb/ft$^3$ being preferred.

The type of fluidizing gas employed in this stage of the process is not critical provided it does not cause spontaneous combustion or otherwise react with the coal at the temperatures achieved in the first preheating zone. Suitable non-interfering fluidizing gases include dilute oxygen-containing gases such as air or flue gas-diluted air, flue gas and inert gases such as nitrogen. A dilute oxygen-containing gas, such as air, is preferred in this step of the process since any preheated coal which passes out of the top of the first preheating zone, having a particle size sufficiently small to avoid gas-solids separation and solids recovery for charge to the second preheating zone can be passed along with its gas carrier to the heating zone for the second particulate heat carrier to supply a portion of the heat required in that zone via combustion (see below). In this manner the thermal efficiency of the process may be improved and its energy requirements reduced by recovering the calorific value of subdivided solid material feedstock which otherwise might be lost in gaseous or associated scrubber effluent.

As mentioned previously, the dilute-phase fluidized bed of subdivided coal is preheated in this first process zone by countercurrent contact with a relatively hot, first particulate heat carrier such that the temperature of the coal leaving the upper portion of the preheating zone is at an elevated level, but not above the boiling point of water. In this process zone, countercurrent contact and sensible heat transfer from the relatively hot, particulate heat carrier to the relatively cool, subdivided coal is established by introducing the particulate heat carrier at the top or upper portion of the vertical process zone and passing it in a downward direction at a uniform rate through the upwardly moving dilute-phase fluidized bed of subdivided coal, the relatively hot, particulate heat carrier being returned from the lower portion of the preheating zone as will appear hereinafter. That is, the particulate heat carrier, usually in the form of spheres, pellets or granules, is introduced at a controlled rate uniformly across the cross-section of a top region of the preheating zone via suitable deflecting device and allowed to fall or rain at a substantially uniform, non-accelerating rate under the influence of gravity against the rising stream of fluidized coal. Designation of the flow of particulate heat carrier in this manner is intended to denote that the individual carrier particles cascade or fall under the influence of gravitational force at apparent bed densities sufficiently low that free movement of the heat carrier particles is not restricted by carrier particle population in the zone, thereby precluding the use of a dense, downwardly moving bed of heat carrier particles. Further, the rate of carrier particle descent through the bed is controlled to a sufficient degree by the opposing fluidizing gas force that it does not continuously accelerate with the action of gravitational force. Under these conditions the heat carrier particles experience a certain amount of sideways and even upwards movement on their descent through the fluidized bed; however, the net flow is in a downwards direction at a substantially uniform rate and backmixing is minimized due to the rate of upward movement of subdivided solid material in the dilute fluidized phase. For countercurrent contact of a dilute-phase fluidized bed of coal according to the invention, the apparent heat carrier densities in the preheating zone will generally range from 1 to 14 lbs/ft$^3$ with resultant heat carrier falling velocities of about 1 to 10 ft/sec in order to obtain the desired heat carrier flow characteristics.

The flow or rate of descent of the first particulate heat carrier through the first preheating zone according to the invention is controlled by several factors well known to those skilled in the art. Principal factors include the particle size and density or specific gravity of the heat carrier particles, the fluidized particle bed density and the opposing fluidizing gas velocity. With the aforementioned fluidizing gas velocities, heat carriers having a specific gravity of from 2 to 8 and a particle size in the range of 1/16" to ⅜" are preferred. In any case, it is preferable that the particle size of the heat carrier be larger by a factor of at least two over the particle size of the subdivided coal to insure effective countercurrent contact and adequate separation of heat carrier from subdivided solid material. Since the primary objective of the preheating (and heat recovery) stage is heat exchange, it is desirable to use heat carriers having as small as possible particle size to maximize heat transfer. Most preferably, the average particle size of the heat carrier should be about ¼" within the range of particle sizes given above. In this same regard, it is desirable to use a heat carrier having as high a heat capacity as possible. Suitable heat carriers have heat capacities in excess of 0.10 btu/lb/°F., with carriers having capacities in the range of 0.12 to 0.25 btu/lb/°F. being preferred. In any case, the specific gravity and particle size of the particulate heat carrier employed in the invention will preferably be such that it can be readily transported by pneumatic action in a carrier gas throughout the process flow scheme.

The composition of the heat carrier employed in the first preheating (and heat recovery) phase of the instant process is rather conventional and includes any solid material having the above-mentioned heat capacity which is relatively inert to chemical and physical degradation in the process. Suitable materials include aluminum,, iron, steel and lead alloys and ceramic materials such as high-density alumina. Most preferred, because of their high-heat capacities, high densities and resistance to chemical and physical degradation, are the ceramic materials such as high-density alumina.

Using the aforedescribed dilute-phase fluidized bed of subdivided solid material and countercurrent contacting with heat carrier, it is generally necessary that the average residence time of subdivided coal in the first preheating zone be maintained between about 10 and 50 seconds to obtain the desired heat transfer.

The first vertically-oriented preheating zone according to the invention may vary widely in design, typically being in the form of a vertically-oriented column or standpipe with appropriate inlets and outlets for subdivided solid material and particulate heat carrier.

Preferably, the first preheating zone is in the form of a vertically-oriented, cylindrical column which is internally equipped with a plurality of baffles or grid plates to promote staging of the countercurrent heat exchange and minimize backmixing. When coal is employed which has significant water content, it may be preferable to employ a vertical column which increases in diameter or internal cross-sectional area with increasing height to compensate for the increase in gas volume due to water vaporization. Suitable preheating zone designs in this case would include those having inverted cone shape and cylindrical columns whose internal diameter is increased in one or more stages in an upward direction. For practical scale preheating, the first preheating zone is suitably 3 to 15 feet in diameter and 50 to 200 feet in height. Preferably, the height of the first preheating zone is about 100 feet for the conditions described above. When baffles or grid staging are employed on a practical scale, it is preferable to use about 5 to 20 sets of baffles or horizontal grid plates spaced at uniform intervals of about 3 to 15 feet along the axis of the first preheating zone. Although the primary function of the first preheat zone is heat transfer, a significant amount of water will be removed in this zone. Normally, depending on residence time, etc., from 10 to 30 percent, or even more, of the water present in the coal will be removed.

After countercurrent contact and sensible heat exchange in the first preheating zone according to the process of the invention, the subdivided coal now at, e.g., 200° F. to 210° F., but not above the boiling point of water passes out the top or upper portion of the first preheating zone and the first particulate heat carrier cooled to a relatively low temperature collects in the lower portion of the first preheating zone. The preheated coal material may be recovered from the upper portion of the first preheating zone via conventional gas-solids separation means, such as one or more high efficiency, high-load cyclone separators, and is passed to the second preheating zone. In this gas-solids separation step substantially all, e.g., 98%, of the preheated coal may be recovered from the fluidizing gas with conventional techniques so that only a very small quantity of very finely-divided solid material remains in the fluidizing gas. This micron-sized solid material can be removed from the fluidizing gas in a conventional gas scrubbing device, e.g., water scrubber or in the case where a dilute oxygen-containing fluidizing gas is employed, it can be passed along with its entraining gas to supply a portion of the heat required elsewhere, as is detailed below. The relatively cool particulate heat carrier which collects in the lower portion or boot of the first vertically-oriented preheating zone will typically contain a minor amount of entrained subdivided solid material. Due to the nature of the fluidized bed operation in this zone, i.e., dilute-phase fluidization, the amount of entrained solid material at the bottom of the process zone is generally quite small, amounting to only about 5% or less of the total solids mass which collects at the bottom of the zone. The relatively cool particulate heat carrier is separated from entrained solid material in the lower portion of the preheating zone by suitable solids-solids separation means, e.g., by elutriation, and is transported, preferably pneumatically, to the heat recovery zone, detailed below. If elutriation is employed, the gas employed in separation of entrained solid material by elutriation is suitably the same gas as is utilized for fluidization in the preheating zone. To effect elutriation, the stripping gas is compressed to a pressure above that required for fluidization in the preheating zone and passed through the heat carrier mass in the lower portion of the preheating zone at a superficial velocity of 10 to 50 ft/sec. The entrained solid material, freed by elutriation, is picked up by the fluidizing gas as part of the dilute-phase fluidized mass. Other means of separation, such as sieving and jigging, may be employed, and other means of transporting the first particulate heat carrier, such as buckets, belts, etc., may be used.

To effect preheating and remove the water remaining in the subdivided coal, the coal is passed into the bottom or lower portion of a vertically-oriented second preheating zone as a dense-phase fluidized mass, contacted with a relatively hot second particulate heat carrier, and is heated to a temperature above the boiling point of water but below the pyrolysis temperature of coal, said second particulate heat carrier also falling or raining through the dense fluidized bed at a substantially uniform rate under the influence of gravity. The larger diameter dense fluidized bed is preferable for the second preheating zone in order to accommodate the large volume of water vapor typically released.

According to the invention, the requisite residence time for water removal and preheat is obtained by introducing the coal from the first preheat zone at a controlled rate, preferably by gravity feed from the upper portion of the first preheating zone, into the second preheating zone with sufficient gas to initiate fluidization such that a dense, well-mixed fluidized bed of subdivided coal is created in the second preheating zone. The fluidized bed formed in this zone corresponds reasonably well with what is known in the art as a dense fluidized bed, in that it exhibits quasi-liquid behavior having a definable upper surface at which the bed density abruptly decreases. The superficial gas velocities used to initiate fluidization in this zone are considerably below those employed for dilute-phase fluidization in the first preheating stage. For example, suitable dense-phase fluidization can be obtained with superficial gas velocities in the range of about 2 to about 8 ft/sec. The gas to solids ratio in the dense fluidized bed according to the invention is essentially meaningless as a process control variable because the water vapor formed on heating of the coal adds significantly to the gas flow through the bed. This water vapor is a significant factor in fluidization, though, since it rises up the vertical preheat zone and adds to the fluidization potential of the zone. Nonetheless, it is preferable to maintain an apparent density in the dense fluidized phase of the second preheating zone of above 15 lbs/ft$^3$ in order to insure adequate residence time in a suitably compact vessel.

The fluidizing gas employed in the second preheating zone should be of the type which will not support combustion. Suitable noninterfering gases include nitrogen, gaseous mixtures made up substantially of light hydrocarbons ($C_4$ and below), oxygen-deficient flue gas and steam. In this application, preference is given to steam since it simplifies the plant start-up procedure. It can also be readily used for elutriation of entrained coal from the particulate heat carrier which collects at the bottom of the second preheating zone (see below).

Sensible heat transfer and heating of the preheated, subdivided coal to a point below pyrolysis temperatures is effected in the second preheating zone by passing a second particulate heat carrier down through the dense-phase fluidized bed in a manner quite similar to that employed in the first preheating zone. That is, the second particulate heat carrier, heated to an appropriate temperature, as outlined more fully hereinafter, is introduced at a controlled rate uniformly across the cross-section of an upper region in the vertically-oriented second preheating zone via suitable deflecting device or distribution grid and allowed to fall or rain at a substantially uniform, non-accelerating rate under the influence of gravity through the dense fluidized bed, against the rising stream of fluidizing gas. As in the first preheating zone, the flow of heat carrier through the second preheating zone is controlled so that the use of a dense, downwardly moving bed of heat carrier is precluded; the apparent heat carrier densities in this zone being in the range of 5–15 lbs/ft$^3$. Because of the increased fluidized bed densities encountered in dense phase operation according to the invention, the falling velocity of particulate heat carrier through the fluidized bed is generally below that encountered in the dilute-phase, first preheating zone. Average carrier falling velocities will be typically in the range of about ⅛ to about 1 ft/sec.

Due to the inherent nature of the dense-phase fluidized bed in the second preheating zone, being a relatively well-mixed mass of fluidized particles, the bulk of the subdivided coal present in the second preheat zone is raised to a temperature level below but approaching that required for pyrolysis. In general, particles leaving the second preheat zone will have a temperature of from about 300° to 600° F., with temperatures of from about 450° to 550° F. being preferred. To achieve this temperature range in the dense fluidized bed, it is necessary to have the second particulate heat carrier at a temperature of about 200° to 700° F. above the temperature required. This temperature differential is adequate to compensate for the cooling effects of the lower temperature, subdivided coal introduced into the zone, and, as a result, a relatively constant temperature is maintained in the fluidized bed. Under these conditions, the temperature of the second particulate heat carrier passed into contact with the dense fluidized bed in the second preheat zone suitably ranges from 800° to 1500° F., with temperatures in the range of 850° to 1000° F. being preferred. Water vapor from the second preheat zone, which may constitute up to 70 percent or even more of the water originally present in the coal, is removed and may be vented or recovered and used in the process.

Upon completion of preheating in the second preheating zone of the invention, the subdivided coal, now completely or substantially completely free of water, is passed to the pyrolysis zone. The coal is suitably withdrawn from the upper portion of the dense bed in the second preheat zone in conventional manner, e.g., cylindrical overflow well or weir on the periphery of the second preheat zone, and transported, e.g., by gravity feed to the pyrolysis zone.

The second particulate heat carrier, which is cooled as it passes downwardly through the dense fluidized bed, collects in the lower portion or boot of the vertically-oriented second preheat zone along with a minor amount of entrained residue. This particulate heat carrier, now at a temperature approximating that of the second preheating zone, e.g., 300° to 600° F. is separated from entrained solid residue in the lower portion of the second preheat zone by suitable solids-solids separation means, such as elutriation, and transported, e.g., pneumatically, to the carrier heating zone, discussed below. If elutriation is employed, the stripping gas employed in separation of entrained material is suitably the same gas as is utilized for fluidization in the second preheat zone. Preferred stripping gases for elutriation in the retorting zone include steam and gases made up substantially of light ($C_4$ and below) hydrocarbons. The entrained solid material, freed from the heat carrier at the bottom of the second preheating zone, is returned to the dense fluidized bed for further process.

The physical and chemical make-up of the heat carrier employed in the second preheat zone (and the pyrolysis zone), i.e., the second particulate heat carrier, is similar to the first particulate heat carrier employed in the first preheat zone and heat recovery. That is, the second particulate heat carrier is also suitably in the form of spheres, pellets or granules of a particle size larger than the particle size of the subdivided solid material by a factor of at least two. In fact, the second particulate heat carrier may be identical in composition and particle size to the heat carrier employed in the first preheat zone and heat recovery. This is convenient because a common source can be utilized for both heat carriers, thereby avoiding costs associated with two separate heat carrier handling and storage facilities. However, it is generally preferable to employ a larger particle size heat carrier in the second preheat zone and the pyrolysis zone to promote easier separation from the fluidized particles. Specifically, it is preferable to employ heat carriers having particle sizes in the range of ⅛" to ⅜". In these instances, the heat carrier employed suitably has a specific gravity of from 2.5 to 8 and a heat capacity of from 0.10 to 0.25 btu/lb/°F. with heat capacities of from 0.18 to 0.25 btu/lb/°F. being preferred. Suitable heat carrier compositions for the second preheat (and pyrolysis) zone of the process include many of the materials mentioned previously as having application in the preheating and heat recovery phases of the process. In particular, particulate heat carriers fabricated from iron, steel, and ceramic materials such as high density alumina are well suited for use in the second preheating phase of the process. Because a greater resistance to high temperatures, thermal shock and chemical attack is generally required in the second preheat zone as contrasted to the preheating and heat recovery zones. Aluminum is generally not suitable, ceramic materials such as high-density alumina being generally preferred. In any case, the particle size and specific gravity of the second particulate heat carrier is such that it can be, if desired, pneumatically transported from one process zone to another as required by the process flow scheme.

The second preheating zone may be designed to accommodate the increased amounts of evolved water vapor while maintaining the dense-phase fluidized bed operation. Accordingly, the second preheat zone is preferably a vertically-oriented chamber of greatly reduced cross-section at its bottom end and expanded cross-section in its upper regions with an overall length in the vertical direction which is somewhat reduced from that required for the first preheating zone. Accordingly, the ratio of the length of the second preheat zone to its width in the upper region will generally not exceed 4. Suitable constructions for the second preheat zone include an upright cylindrical column having a reduced diameter or conical shape at its lower end, or merely an inverted cone with the base of the cone forming the top of the second preheat zone. If a cylindrical column is employed, it is desirable to increase its diameter one or more times in an upward direction alongs its axis to accomodate the increased vapor phase volume as water removal is achieved, without disturbing the dense fluidized bed operation. The second preheat zone is preferably sized such that the height of the dense bed is in the range of 10–60 feet and the diameter between 20 and 40 feet, with an overall zone height of from 50 to 125 feet. This zone is equipped with appropriate inlets and outlets for subdivided coal, particulate residue and heat carrier, as well as a means for introducing fluidizing gas (distribution grid or diaphram) and internal or external cyclone separators for knockdown of entrained particles in the vapor overhead.

The relatively cool second particulate heat carrier from the second preheat zone is passed, preferably pneumatically, to a carrier heating zone. The heat carrier is heated therein to a point above the pyrolysis temperature of coal, and the carrier is then forwarded, according to the invention, to the pyrolysis section. Accordingly, temperatures of the second particulate heat carrier leaving the carrier heating zone will range from 1000° to 1800° F., preferably from 1100° F. to 1400° F. After transfer of a portion of its heat in the pyrolysis zone, the second particulate heat carrier is recovered and forwarded to the second preheat zone, thus completing an inner loop in the process. The operation of the pyrolysis step will now be described.

To effect pyrolysis of the preheated, subdivided, dried coal, the coal is passed into the lower or mid portion of a vertically-oriented pyrolysis zone as a dense-phase fluidized mass and contacted with the second particulate heat carrier which is heated to a temperature above that required for pyrolysis in the separate carrier heating zone, said second particulate heat carrier also falling or raining through the dense fluidized bed at a substantially uniform rate under the influence of gravity. While sensible heat transfer from the second particulate heat carrier is essential for pyrolysis of the preheated solid material in the pyrolysis zone, the controlling process variable in this zone is not heat transfer, but rather, it is the pyrolysis reaction rate. That is, the residence time at pyrolysis temperatures required for the coal to undergo thermal conversion into gaseous and liquid fluids of a hydrocarbonaceous nature, leaving a solid char residue, exceeds the residence time required for heating to and maintaining at the pyrolysis temperatures.

According to the invention, the requisite residence time for pyrolysis is obtained by introducing the preheated coal at a controlled rate, preferably by gravity feed, from the upper portion of the second preheating zone, into the pyrolysis zone with sufficient gas to initiate fluidization such that a dense, well-mixed fluidized bed of solid material is created in the pyrolysis zone. The fluidized bed formed in this zone corresponds reasonably well to that employed in the second preheat zone. As in the second preheat zone, suitable dense-phase fluidization can be obtained with superficial gas velocities in the range of about 2 to about 8 ft/sec. Similarly, the gas to solids ratio in the dense fluidized bed of the pyrolysis zone is essentially meaningless as a process control variable since the vapor or gas formed on pyrolysis of the solid material adds significantly to the gas flow through the bed. This pyrolysis gas or vapor is a significant factor in fluidization, since it rises up the vertical pyrolysis zone and adds to the fluidization potential of the zone. As noted, it is preferable to maintain an apparent density in the dense fluidized phase of the pyrolysis zone of above 15 lbs/ft$^3$ in order to insure adequate residence time in a reasonably sized vessel.

The fluidizing gas employed in the pyrolysis zone should be of the type which will not support combustion of carbonaceous matter. Suitable non-interfering gases include nitrogen, gaseous mixtures made up substantially of light hydrocarbons ($C_4$ and below), oxygen-deficient flue gas and steam. Light hydrocarbon gases or steam are preferred.

Sensible heat transfer and heating of the preheated, subdivided coal to pyrolysis temperatures is effected in the pyrolysis zone by passing the second particulate heat carrier down through the dense-phase fluidized bed in a manner quite similar to that employed in the second preheating zone. That is, the second particulate heat carrier, heated to an appropriate temperature in the carrier heating zone, is introduced at a controlled rate uniformly across the cross-section of an upper region in the vertically-oriented retorting zone via suitable deflecting device or distribution grid and allowed to fall or rain at a substantially uniform, non-accelerating rate under the influence of gravity through the dense fluidized bed, against the rising stream of fluidizing gas. As in the preheating zones, the flow of heat carrier through the retorting zone is controlled so that the use of a dense, downwardly moving bed of heat carrier is precluded; the apparent heat carrier densities in this zone being in the range of 5–15 lbs/ft$^3$. The average carrier falling velocities are typically in the range of about ⅛ to about 1 ft/sec.

Due to the inherent nature of the dense-phase fluidized bed in the pyrolysis zone, being a relatively well-mixed mass of fluidized particles, the bulk of the subdivided coal present in the retorting zone is maintained at the temperature level required for pyrolysis. As indicated, the pyrolysis temperature or temperature of the bulk of the dense fluidized bed in the retorting zone suitably ranges from about 800° F. to 1500° F., with temperatures in the range of 850° F. to 1000° F. being preferred. Under these conditions, the temperature of the second particulate heat carrier passed into contact with the dense fluidized bed in the pyrolysis zone suitably ranges from 1000° F. to 1800° F. with temperatures in the range of 1100° F. to 1400° F. being preferred. Residence times in the pyrolysis zone range from 3 to 15 minutes with from 5 to 10 minutes being preferred.

Pyrolysis of preheated coal according to the invention yields a vapor phase containing hydrocarbonaceous fluids and a solid char residue. This char residue tends to be of somewhat finer particle size than the subdivided coal feedstock due to both thermal and physical stresses in the retort zone combined with the loss of pyrolyzed carbonaceous matter. The char residue represents a valuable product of the process of the invention, and utilization may be made of the char in the process, as well as recovering a portion thereof for further use or sale.

Upon completion of pyrolysis in the dense-phase fluidized bed, pyrolysis zone of the invention, the char is withdrawn from the dense fluidized phase and transported to the heat recovery zone, detailed below. This particulate residue, at a temperature approximating the pyrolysis zone temperatures, e.g., 800° F. to 1500° F., is suitably withdrawn from the dense bed in the pyrolysis zone in any conventional manner, and transported, e.g., by gravity feed to the heat recovery zone. The hydrocarbonaceous fluid-containing vapor phase obtained on pyrolysis passes in admixture with the fluidizing gas, in an upwards direction through the dense fluidized bed into the upper portion of the pyrolysis zone. A minor amount of finer particle size solid material and retorted particulate residue is entrained in this upwardly moving gas mixture as it passes through the dense fluidized bed. This finely-divided material, which forms a dilute suspension in the vapor phase above the fluidized bed, is suitably removed from the entraining gas by one or more internal cyclone separators and returned to the bed to retain the fluidized bed inventory. Since the potential for vapor condensation exists in this vapor space above the dense fluidized bed, it is preferred to inject superheated steam into this vapor section to minimize cooling and condensation. After removal of entrained solids, the hydrocarbonaceous fluid-containing vapor phase is passed out the top of the pyrolysis zone to conventional product recovery where it is condensed, fractionated and otherwise processed into useful components.

The second particulate heat carrier, which is cooled to near pyrolysis temperatures as it passes downwardly through the dense fluidized bed, collects in the lower portion or boot of the vertically-oriented pyrolysis zone along with a minor amount of entrained solid material. This particulate heat carrier, now at a temperature approximating that of the dense fluidized bed, e.g., 800° F. to 1500° F. is separated from entrained solid residue by suitable solids-solids separation means, such as elutriation, and transported, e.g., pneumatically, to the second preheat zone, discussed previously. If elutriation is employed, the stripping gas employed in separation of entrained material is suitably the same gas as is utilized for fluidization in the pyrolysis zone. Preferred stripping gases for elutriation in the retorting zone include steam and gases made up substantially of light ($C_4$ and below) hydrocarbons. The entrained solid material, freed from the heat carrier, is returned to the dense fluidized bed for further process.

The design of the pyrolysis zone is similar to that of the second preheat zone, and need not be detailed herein, such differences in required construction being evident to and readily appreciated by those skilled in the art.

In one preferred embodiment of the invention, the dense fluidized bed retorting phase of the process is staged by disposing one or more horizontally-oriented separator grids, baffles or grates along the length of the pyrolysis zone in the area where the dense fluidized bed occurs. These interstage separator grates, or the like, reduce the retort cross-sectional area by 50 to 85%, thereby raising the fluidizing gas velocity to a level high enough to entrain and spout particles into the next stage. The net effect of using such stage separators is to minimize backmixing of fluidized particles while ensuring that larger fluidized particles do not accumulate in the lower regions of the fluidized bed. By reducing backmixing, the residence time required for pyrolysis is also reduced, such that when 3 or more interstage separators are employed it is possible to cut the pyrolysis residence time by a factor of 50% or more. In this context, it is most preferred to employ 3–5 interstage separators of the type previously described, e.g., grates fabricated from I beams. In this system, it is desirable to segregate the flow of heat carrier to the pyrolysis zone such that a portion of fresh heat carrier is introduced into each stage of the fluidized bed.

As mentioned previously, the second particulate heat carrier utilized for sensible heat transfer in the second preheat zone and the pyrolysis zone is heated to a temperature above that required for pyrolysis in a separate carrier heating zone prior to being placed into contact with the dense fluidized bed in the pyrolysis zone. This separate carrier heating zone may be rather conventional in nature, being, e.g., a combustion heater or furnace wherein the second particulate heat carrier is heated indirectly or directly with the hot gaseous product of combustion. Suitable carrier heating zone designs include those wherein the particulate heat carrier is heated directly by contact with the hot combustion gas in a cross-current moving bed or a co-current entraining bed. It is also possible to rain the second particulate heat carrier particles down through an upwardly moving stream of hot combustion gas in a manner quite similar to that employed in the preheating stage of the process to effect countercurrent heat exchange. As a general matter, supplemental air and fuel will be required to generate the necessary heat for carrier heating. In the preferred embodiment of the invention, a portion of the char residue from the heat recovery zone is combusted in the carrier heating zone to provide the heat for raising the heat carrier to the desired temperatures. As also mentioned previously, the preheated solid material fines not recovered by gas-solids separation at the top or upper portion of the first preheating zone can also be utilized as a fuel source in this carrier heating zone, if a dilute oxygen-containing gas is employed as the fluidizing gas in the first preheating zone. In this preferred embodiment, the solid material fines are mixed with a portion of supplemental fuel and fed to the combustion heater along with their carrier gas which, itself, satisfies part of the oxygen requirements for combustion. The hot flue gas which is generated by combustion in the carrier heating zone can be used to generate high pressure steam for the process. Preferably, the hot flue gas stream is split into at least one other stream such that a portion of the hot gas is utilized as the fluidizing gas source in heat recovery (see below). Alternatively, additional portions of the hot flue gas may be used as the transporting gas to move second particulate heat carrier, pneumatically, from the bottom of the pyrolysis zone to the second preheat zone; as the transporting gas to move the first particulate heat carrier from the bottom of the heat recovery zone to the top of the first preheating zone; and as the source of fluidizing gas in the pyrolysis zone. By any or all of these measures, the heat content of the flue gas is conserved in the process. From a procedural standpoint, heating of the second particulate heat carrier may be effected in the carrier heating zone by transporting heat carrier, preferably pneumatically, which collects in the lower portion of the second preheat zone after separation from the residue, preferably by elutriation, to the carrier heating zone, raising its temperature to that required for retorting in the carrier heating zone and passing it back into the upper portion of the retort zone via appropriate piping and valving. In this manner, a closed loop for heat carrier flow around the retort zone may be established and the heat content of the second particulate heat carrier is thereby conserved. While flue gas from the carrier heating zone may be employed to transport the heat carrier pneumatically from the second preheat zone to the carrier heating zone, air is preferably employed for this purpose. By using air as the carrier gas for pneumatic transport to the carrier heating zone, at least a portion of the air requirements for combustion in that zone can be satisfied, giving the carrier air a two-fold function in the process.

The char residue recovered from the pyrolysis zone is subjected to heat recovery by countercurrent contact with the relatively cool, first particulate heat carrier separated at the bottom of the first preheating zone. Preferably, the heat exchange is carried out in much the same manner as was employed in the preheating zone. That is, the char residue is preferably introduced at temperatures approximating those employed in pyrolysis as an upwardly moving, dilute-phase fluidized mass in the lower portion of a vertically-oriented heat recovery zone and countercurrently contacted with the first particulate heat carrier from the bottom of the first preheating zone, said first particulate heat carrier being introduced at the top or upper portion of the vertical heat recovery zone and passed downwardly at a substantially uniform, non-accelerating rate under the influence of gravity through the upwardly moving dilute-phase fluidized bed. In this case, the sensible heat exchange is such that the char residue leaves the upper portion or top of the heat recovery zone at a relatively cool temperature and the first particulate heat carrier collects in the lower portion of the heat recovery zone at a temperature approximating that required for sensible heat transfer in the first preheating zone. In this preferred embodiment, the operation of the heat recovery zone, with the minor exceptions noted below, is similar to the operation of the first preheating zone. Thus, the same process definitions relative to dilute-phase operation and heat carrier flow detailed for the first preheating zone apply to the heat recovery zone. Further, almost all of the process parameters defining fluidized bed and heat carrier flow characteristics for the first preheating of the coal are also applicable to the heat recovery zone operation. The only important distinction in this regard is that the char residue passed into the heat recovery zone will generally have a smaller particle size than the subdivided solid material fed to the preheating zone. This particle size difference is such that the average particle size of the char residue is less than half of the average particle size of the subdivided coal feedstock. Such differences in particle size are not sufficient to upset or change any of the preheating zone process parameters detailed previously. Other methods of heat recovery may be employed.

If the preferred heat recovery scheme is employed, the fluidizing gas used is preferably hot flue gas from the carrier heating zone. However, the use of other gases such as steam or an inert gas such as nitrogen is not precluded. After sensible heat exchange in the heat recovery zone, the fluidizing gas may be separated from the entrained char residue, now in a relatively cool condition, by means of conventional gas-solids separation, such as one or more high efficiency, high-load cyclone separators. After removal of all or substantially of the entrained solids by gas-solids separation, the fluidizing gas, combined with other cool gas disposal streams in the process, e.g., flue gas from the carrier heating zone and fluidizing gas from the first preheating zone after their heat contents have been recovered, is vented to the atmosphere. The relatively cool char residue separated from the upper portion of the heat recovery zone may be cooled further via direct or indirect means, e.g., by contact with water spray, and sent to storage or shipping. Preferably, however, at least a portion of the char is employed as a fuel source in the carrier heating zone, as indicated previously.

The first particulate heat carrier which collects in the lower portion or boot of the heat recovery zone will typically contain a minor amount of entrained particulate residue. This entrained particulate residue, which is present in a minor amount similar to that found in the lower portion of the first preheating zone, is separated from the heat carrier by a solids-solids separation means equivalent to that employed in the first preheating zone. When elutriation is employed to effect separation of entrained particulate residue in this zone, the stripping gas is preferably a substantially oxygen-free gas such as flue gas, steam or nitrogen. After solids-solids separation, the first particulate heat carrier, now at a temperature approximating that desired for sensible heat exchange in the first preheating zone, is transported back to the first preheating zone where it supplies substantially all of the heat required for preheating subdivided coal in that zone. If pneumatic transport is employed, suitable carrier gases in this phase of the process include air, steam and inert gases such as nitrogen and flue gas, with hot flue gas from the carrier heating zone being preferred.

The specific temperatures to which the char residue is cooled and the first particulate heat carrier is heated in the heat recovery zone of the process of the invention will depend on a variety of factors. As a general matter, the temperature of the cooled char residue leaving the heat recovery zone according to the invention will be about 600° F. to 1100° F. below the retorting temperature. Generally, pyrolysis according to the invention suitably produces a char residue having a temperature of from about 850° F. to about 1000° F., while the first particulate heat carrier leaving the bottom of the preheating zone generally has a temperature in the range of about 100° F. to about 200° F. Passing these two streams into countercurrent contact in the heat recovery zone of the process of the invention affords a heat carrier having a temperature in the range of from about 450° F. to about 650° F. and a cooled char residue having a temperature of from about 150° F. to about 300° F.

The design of the heat recovery zone is preferably quite similar to the preheating zone design. In this case, however, it is preferred that the column reduce or stay constant, rather than expand, in diameter with increasing height to compensate for contractions in fluidizing gas volume as it is cooled. As with the first preheating zone, it is also preferred that the heat recovery zone be internally equipped with a plurality of baffles or grid plates to promote staging of the countercurrent heat exchange and to minimize backmixing. For practical scale heat recovery from char residue, the heat recovery zone is suitably 3 to 15 feet in diameter and 50 to 200 feet in height. Preferably, the height of the heat recovery recovery zone is 90 feet for the conditions described above. When baffles or grid staging are employed on a practical scale, it is preferable to use about 5 to 20 sets of baffles or horizontal grid plates spaced at uniform intervals of about 3 to 15 feet along the axis of the heat recovery zone.

Reference is made to the drawing, which illustrates an embodiment of the process in accordance with the invention.

In the embodiment shown, raw crushed coal is fed via line 1, which is typically a conveyor belt or other mechanical carrying device, to a ball mill, 2, where it is ground to a readily fluidizable size range, e.g., 1/16×0 inch. This milled or comminuted coal is then passed by line 3, suitably a gravity or screw feeding device, into the bottom of the preheating zone 4 at a controlled rate. There, the subdivided coal is picked up by a fluidizing gas introduced into the preheating zone by line 5 and carried up through the preheating zone in the form of a dilute-phase fluidized bed. In this embodiment the fluidizing gas is flue gas from the carrier heater phase of the process. Concomitant with the introduction of comminuted coal as a dilute-phase fluidized bed in the preheating zone 4, a first particulate heat carrier in the form of ¼" diameter alumina or ⅛" diameter steel balls having a zone inlet temperature of about 540° F. is introduced via line 6 and rained downwardly at a substantially uniform non-accelerating rate under the influence of gravity through the dilute-phase fluidized bed. On entering the top portion of the preheating zone 4 the heat carrier particles impact on a conical deflector plate (not shown) to distribute their flow uniformly over the cross-section of the preheating zone. Sensible heat exchange effected countercurrently in this zone raises the temperature of the fluidized coal particles to about 210° F. near the top of the preheating zone. These preheated coal particles and carrier gas exit near the top of the preheating zone and are transported, after separation from the fluidizing gas, via line 7 to the bottom of the second preheating zone 8. The fluidizing gas (flue gas), containing water vapor and a minor amount of very fine coal separated from the preheated coal in the preheater 4, is taken overhead via line 9 and scrubbed. The first particulate heat carrier collects at the bottom of zone 4 at a temperature of about 150° F. as a result of sensible heat exchange with the incoming fluidized coal particles. This relatively cool heat carrier, which contains a minor amount of entrained coal, is subjected to elutriation with a slip stream of the fluidizing gas in the lower portion of the preheating zone (not shown) and passes out of the bottom of the preheating zone (4) substantially free of entrained coal particles via line 10 for pneumatic transport to the heat recovery zone, detailed below. For improved temperature reduction of the char in the heat recovery zone, the first particulate heat carrier may be passed through an intermediate cooler to lower its temperature to about 75° F. (not shown).

To effect complete water removal and preheating, the coal particles in line 7 enter the lower portion of the preheat zone 8 where they are carried in an upward direction as a dense-phase fluidized bed by low pressure steam (350° F.) injected via line 11 and the vapors produced on heating. It is preferred that this preheat zone be expanded in cross-sectional area in its upper portions to accommodate the vapor volume released on water removal without destroying the dense fluidized bed operation. Concomitant with the upward passage of the dense fluidized bed of preheated coal in preheat zone 8, a seond particulate heat carrier in the form of ¼" diameter alumina balls is passed downwardly from inlet line 12 at about 900° F. through the dense fluidized bed thereby heating the coal particles to about 500° F. and vaporizing the remainder of the water in the coal. The steam is removed in line 13. The preheated coal is removed from the dense fluidized bed via line 14 and passed by gravity and/or screw feed to the bottom of the pyrolysis zone 15, detailed below. Upon passing through the dense fluidized bed contained in the preheat zone 8, and transferring sensible heat to the fluidized coal particles, the second particulate heat carrier collects at the bottom of the second preheat zone at a temperature of about 500° F. along with a minor portion of entrained coal particles. This second particulate heat carrier, now cooled to the temperature of the preheat zone, is separated from the entrained coal particles by elutriation with a slip stream of fluidizing steam in the bottom of the preheat zone (not shown) and passed out the bottom of the preheat zone essentially free of the entrained solids via line 16 for pneumatic transport to the carrier heating zone. In line 16, which is suitably a small diameter lift pipe, the second particulate heat carrier is entrained in a stream of compressed air introduced into line 16 which carries the particulate heat carrier up into the carrier heating zone 17.

Carrier heating zone 17 is a fast fluidized bed with heat carrier particles entering at the top at about 500° F. and exiting the bottom in line 18 at about 1200° F. Char and preheated air enter from lines 19 and 20, respectively, air being in excess for complete combustion. Circulating sand may also be present to increase the density of the rising heat transfer fluid. Sand is removed by suitable means at the top of vessel 17. In the embodiment shown, the carrier heater has internal baffles to slow the particles' descent. The air utilized as the entraining gas for pneumatic transport of the heat carrier in line 16 also combines with the mixture of air and char in the carrier heating zone 17 to supply part of the oxygen requirements for combustion. Flue gas leaves the carrier heating zone 17 via line 21.

To effect retorting, the preheated coal at 500° F. is passed via gravity and/or screw feeder device in line 14 to the lower portion of the retorting zone, 15, where it is carried in an upward direction as a dense-phase fluidized bed by recycle light product gas injected via line 22 and the vapors produced on pyrolysis. This pyrolysis or retorting zone is preferably expanded in cross-sectional area in its upper portions to accommodate the vapor volume released on pyrolysis without destroying the dense fluidized bed portion. Concomitant to the upward passage of the dense fluidized bed of preheated coal in the retorting zone, the second particulate heat carrier in the form of ¼" diameter alumina balls is passed downwardly from line 18 at about 1200° F. through the dense fluidized bed thereby heating the coal particles to about 900° F. and supplying the pyrolysis heat requirement. As a result of retorting or pyrolysis in this zone, the preheated coal is converted into a vapor phase containing hydrocarbonaceous fluids and a particulate phase comprising a solid char residue substantially at the temperature of the dense fluidized bed (900° F.). The retorted particulate char residue which predominates in the dense fluidized bed in the pyrolysis zone, e.g., 90%+ char residue, is removed via line 23 at about 900° F. from the dense fluidized bed and passed via gravity and/or screw feed to the bottom of the heat recovery zone 24, detailed below. Entrained vapors from the particulate residue are preferably stripped in this line or in a separate vessel using superheated steam. The vapor overhead from the pyrolysis zone containing the hydrocarbonaceous fluid of retorting and associated fluidizing gas is removed via line 25 from the top of the retorting zone, after being freed from entrained fluidized solids by one or more internal cyclone separators (not shown), and passed to product recovery (not shown). This vapor overhead is at a temperature of about 900° F.; therefore, to avoid formation of coke in the product transfer line 25, superheated steam at 1200° F. is injected at one or more points along line 25 or in the top of vessel 15. Upon passing through the dense fluidized bed contained in the pyrolysis zone 15, and transferring sensible heat to coal particles and retorted particulate char residue, the second particulate heat carrier collects at the bottom of the pyrolysis zone at a temperature of about 900° F. along with a minor portion of entrained coal particles and retorted char residue. This second particulate heat carrier, now cooled to pyrolysis temperature, is separated from the entrained coal particles and particulate char residue by elutriation with a slip stream of fluidizing steam in the bottom of the pyrolysis zone (not shown) and passed out the bottom of the pyrolysis zone via line 12 for pneumatic transport to the second preheat zone 8.

To effect heat recovery, the retorted particulate char residue at about 900° F. is passed via line 23 in the manner described above into the bottom portion of the heat recovery zone 24, where it is carried in an upward direction as a dilute-phase fluidized bed by the action of flue gas. Sensible heat exchange is effected in the heat recovery zone in a manner similar to that employed in the first preheating zone in that the first particulate heat carrier is passed via line 10 at a zone inlet temperature of about 150° F. downwardly, in countercurrent fashion, through the dilute-phase fluidized bed at a substantially uniform velocity under the influence of gravity. This first particulate heat carrier, at low temperature in line 10 as a result of heat exchange in the first preheating zone, is routed to the top of the heat recovery zone for introduction into that zone by pneumatic transport. After sensible heat exchange in the heat recovery zone, the particulate char residue passes out the top of that zone as a dilute fluidized phase at a temperature of about 250° F. After separation from the fluidizing gas, a portion of the char is sent via line 19 to carrier heater 17 for use as fuel therein, while the remainder is sent to char cooler 26 via line 27. The first particulate heat carrier, now at a temperature of about 520° F. is passed via line 6 to the first preheat zone 4.

Although not shown, judicious use of flue gas in the process provides additional economies. For example, flue gas from the carrier heater 17 may be used for lift and for supply of trim heating to the first particulate heat carrier, raising its temperature, e.g., from about 520° F. to about 540° F.

While the invention has been illustrated with particular apparatus, those skilled in the art will appreciate that, except where specified, other equivalent or analogous units may be employed. The term "zones", as employed in the specification and claims, includes, where suitable, the use of segmented equipment operated in series, or the division of one unit into multiple units because of size constraints, etc. For example, the preheat zone might comprise two separate preheat columns in which the heat carrier falling to the lower portion of the first column would be introduced into the upper portion of the second column, the coal from the upper portion of the second column being fed into the lower portion of the first column. Parallel operation of units is, of course, well within the scope of the invention.

We claim as our invention:

1. A process for the pyrolysis of coal comprising, (a) countercurrently contacting coal subdivided to a particle size fluidizable in gas in the form of a relatively cool, upwardly moving fluidized mass in a first vertically-oriented preheating zone with an inert relatively hot first particulate heat carrier thereby transferring sensible heat from the heat carrier to the subdivided coal and heating said coal to an elevated temperature not above the boiling point of water, said coal being fluidized in gas in a manner to create a dilute-phase fluidized mass in said first preheating zone and said particulate heat carrier being introduced in the upper portion of the preheating zone and having a particle size and density such that it falls through the dilute-phase fluidized mass at a substantially uniform rate and collects in the lower portion of the vertical preheating zone as a relatively cool first particulate heat carrier;

(b) recovering the bulk of said subdivided coal at elevated temperature in the upper portion of said preheating zone and passing said recovered coal to a second preheating zone;

(c) recovering said relatively cool first particulate heat carrier in the lower portion of said preheating zone, and passing said recovered heat carrier to a heat recovery zone;

(d) introducing said subdivided coal at elevated temperature into a second verticaly-oriented preheat zone as a dense phase, fluidized mass in gas, and countercurrently contacting said fluidized mass with a second inert particulate heat carrier heated to a temperature above the boiling point of water to transfer sensible heat from the heat carrier to the coal and remove any water in the coal, said second particulate heat carrier being introduced in the upper portion of the second preheat zone wherein its particle size and density are such that it falls at a substantially uniform rate and collects in the lower portion of the vertical zone along with a minor amount of entrained solid material;

(e) removing water from the upper portion of said second preheat zone, and also removing preheated subdivided coal separately from the upper portion of the second preheat zone;

(f) recovering said second particulate heat carrier from the lower portion of said second preheat zone and passing said recovered heat carrier to a carrier heating zone wherein the carrier's temperature is raised to a level above that required for pyrolysis, and passing said second particulate heat carrier after heating to the upper portion of a pyrolysis zone;

(g) introducing said subdivided preheated coal at elevated temperature into a vertically-oriented pyrolysis zone as a dense phase, fluidized mass, and contacting said fluidized mass with said second particulate heat carrier heated to a temperature above that required for pyrolysis to transfer sensible heat from the heat carrier to the subdivided coal and obtain a vapor phase containing hydrocarbonaceous fluids and a char residue, said second particulate heat carrier having been passed from the carrier heating zone and introduced in the upper portion of the pyrolysis zone wherein its particle size and density are such that it falls at a substantially uniform rate and collects in the lower portion of the vertical pyrolysis zone along with a minor amount of entrained solid material;

(h) recovering said hydrocarbonaceous fluids from the upper portion of said pyrolysis zone;

(i) separating said second particulate heat carrier in the lower portion of said pyrolysis zone from entrained solid material and char residue and passing said separated second particulate heat carrier to the second preheat zone;

(j) removing solid char residue from the dense fluidized phase in the pyrolysis zone and passing the char residue to a heat recovery zone;

(k) introducing the solid char residue from the pyrolysis zone into a heat recovery zone, and countercurrently contacting said residue with the relatively cool, first particulate heat carrier from the preheating zone to transfer sensible heat from the residue to the first particulate heat carrier, and returning said relatively hot first particulate heat carrier to the first preheating zone;

(l) recovering said relatively cool particulate char residue from the heat recovery zone.

2. The method of claim 1 wherein the temperature of the subdivided preheated coal introduced into the pyrolysis zone is from about 300° F. to 600° F., and the temperature of the second particulate heat carrier contacting said subdivided preheated coal is from 1000° F. to 1800° F.

3. The process of claim 1, wherein the coal contains up to 40 percent water.

4. The process according to claim 3, wherein a portion of the char residue is used for fuel in the carrier heating zone.

* * * * *